US010435120B2

(12) United States Patent
O'Rourke

(10) Patent No.: US 10,435,120 B2
(45) Date of Patent: Oct. 8, 2019

(54) WAVE RIDING BOARDS

(71) Applicant: Alverno Management Company, Swarthmore, PA (US)

(72) Inventor: Steve O'Rourke, Waretown, NJ (US)

( * ) Notice: Subject to any disclaimer, the term of this patent is extended or adjusted under 35 U.S.C. 154(b) by 0 days.

(21) Appl. No.: 15/848,848

(22) Filed: Dec. 20, 2017

(65) Prior Publication Data

US 2019/0185113 A1 Jun. 20, 2019

(51) Int. Cl.
*B63B 35/79* (2006.01)
*B63B 1/20* (2006.01)

(52) U.S. Cl.
CPC ..... *B63B 35/79* (2013.01); *B63B 1/20* (2013.01); *B63B 35/7909* (2013.01); *B63B 2001/202* (2013.01); *B63B 2035/7903* (2013.01)

(58) Field of Classification Search
CPC ... B63B 35/79; B63B 1/20; B63B 2035/7903; B63B 2001/202; B63B 35/7909
USPC ..... 441/74
See application file for complete search history.

(56) References Cited

U.S. PATENT DOCUMENTS

| | | | | |
|---|---|---|---|---|
| 2,423,796 | A * | 7/1947 | Platt, Jr. | B63B 1/20 114/289 |
| 3,276,050 | A | 10/1966 | Edwards | |
| 3,289,227 | A | 12/1966 | Kelly, Jr. | |
| 3,800,725 | A | 4/1974 | L'Heureux | |
| 3,996,869 | A | 12/1976 | Hadley | |
| 4,767,370 | A | 8/1988 | Campbell | |
| 5,273,470 | A | 12/1993 | Sneddon et al. | |
| 2,355,302 | A | 8/1994 | Kirchner | |
| 5,339,761 | A | 8/1994 | Huang | |
| 6,007,393 | A | 12/1999 | Choiniere et al. | |
| 6,415,731 | B2 | 7/2002 | Chrunyk | |
| 6,718,897 | B1 | 4/2004 | De Bello | |
| 7,410,399 | B2 | 8/2008 | Blumenfeld | |
| 7,717,763 | B2 | 5/2010 | Lei | |
| 2002/0178984 | A1 * | 12/2002 | Keller | B63B 1/20 114/39.14 |

* cited by examiner

*Primary Examiner* — Anthony D Wiest
(74) *Attorney, Agent, or Firm* — Quarles & Brady LLP

(57) ABSTRACT

Embodiments of a wave riding board include a body having a top, a bottom, a right edge, a left edge, a front, a rear and a length defined from the front to the rear. The bottom of the body includes a plurality of steps and a channel defined between at least a portion of the plurality of steps. The channel extends along at least a portion of the length of the body.

18 Claims, 2 Drawing Sheets

WAVE RIDING BOARDS

BACKGROUND

The present disclosure relates generally to wave riding boards and to wave riding, and more specifically to surfboards and surfing. Riding waves in water is a popular recreation that involves riding a board that travels along or across water, including any waves or currents produced by the water. New and improved wave riding boards that enhance the appeal of wave riding, improve the ease and simplicity of using such boards, and increase the overall wave riding experience are needed.

Figure 1:
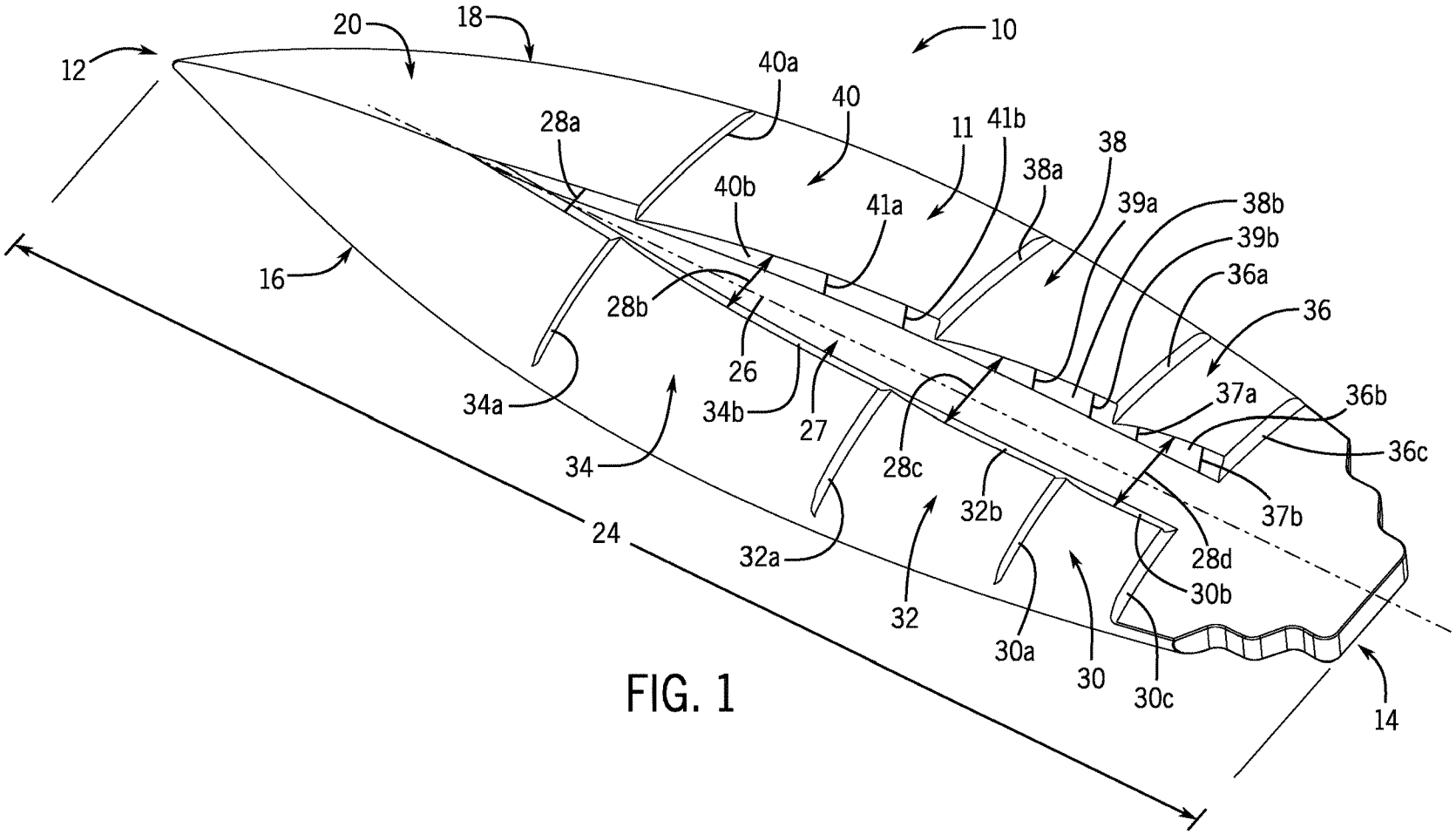
FIG. 1 illustrates a perspective view of a wave riding board according to one embodiment of the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

Figure 2:
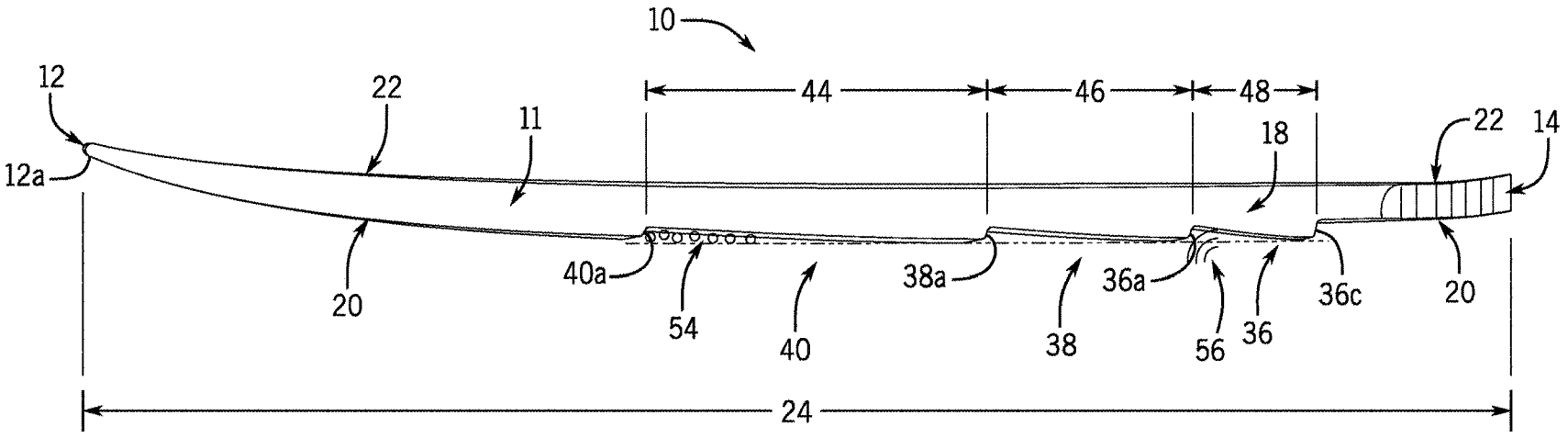
FIG. 2 illustrates a left side view of the wave riding board of FIG. 1.

FIGS. 1 and 2 illustrate one embodiment of a wave riding board 10 (e.g., a surfboard, or a bodyboard) according to the present disclosure. The wave riding board 10 includes a body 11 having a front 12, a rear 14, a right edge 16, a left edge 18, a bottom 20, a top 22 and a length 24 defined from the front 12 to the rear 14. A center longitudinal axis 26 is defined along or through a center of the body 11 and runs in a direction from the front 12 to the rear 14 of the body 11 (or the rear 14 to the front 12). The bottom 20 includes a channel 27 and a plurality of steps 30, 32, 34, 36, 38 and 40. The channel 27 is defined in or through a center portion of the bottom 20, and is between adjacent ones of the plurality of steps 30-40. The bottom 20 may be convexly shaped, may curve laterally from the right edge 16 to the left edge 18, and may curve longitudinally from the front edge 12 to the rear 14. The center portion of the body 11 may be thicker than right or left portions of the body 11 (i.e., the body 11 may be thinner going from the center to each of the right edge 16 and the left edge 18).

The plurality of steps 30-40 and channel 27 help prevent suction between the bottom 20 of the board 10 and the water on which the board 10 travels by creating breaks or voids between the bottom surface of the board 10 and the water. The breaks allow air to be distributed efficiently under the bottom 20 of the board 10. When the board 10 moves against current or waves in the water, air flows under the steps 30-40 of the board 10 to create lift while water simultaneously flows smoothly through the center channel 27 reducing the amount of energy or force required to paddle into the waves or current. When the board 10 moves with current or waves in the water (e.g., catching a wave in an ocean), water collides with lateral walls of the steps 30-40 to create additional thrust in the direction of the current or waves. The longitudinal distance between the lateral walls of the steps increases (going from the front 12 to the rear 14 of the board 10) to help eliminate hydrodynamic drag on the board 10. The reduction in drag occurs due to the volume of water under a first or front step (going from front to rear) being greater than a volume of water under a second or middle step, and/or the volume of water under the second or middle step being greater than a volume of water under a third or rear step (going from front to rear). The greater volume of water under the first step creates (relative to the second step) greater water pressure under the first step, which pushes away or clears the smaller and lighter volume of water under the second step. Likewise, the greater volume of water under the second step (relative to the third step) creates greater water pressure under the second step, which pushes away or clears the smaller and lighter volume of water under the third step (and so forth when there are more steps). This stepped configuration along with the spatially offset arrangement of steps having different longitudinal distances between the steps (described more below) advantageously reduces drag on the board 10 and improves the overall enjoyment of a person using the board 10.

Referring more specifically to the features illustrated in the embodiment of FIGS. 1 and 2, the plurality of steps 30-40 of the wave riding board 10 include a right front side step 34, a right middle side step 32, a right rear side step 30, and corresponding or adjacent left front side step 40, middle side step 38 and rear side step 36. Each of the right side steps 30, 32, 34 and respective adjacent left side steps 36, 38 and 40 are symmetrical or substantially symmetrical about the center longitudinal axis 26 of the body 11. The channel 27 is defined between each of the right side 30, 32, 34 and left side 36, 38 and 40 steps, and extends along a portion of the length 24 of the wave riding board 10. In the illustrated embodiment, the channel 27 extends through a center portion of the bottom 20 of the wave riding board 10 beyond the right front side step 34 and left front side step 40, terminating before the front 12 of the board 10. The channel 27 may in alternative embodiments be defined between any numbers of steps along the length 24 of the board 10, and may extend any portion of the length 24 of the board 10 including the entire length. The board 10 may include any suitable number of steps for providing the hydrodynamic advantages and enhanced riding experiences described herein. For example, in certain embodiments, instead of having three steps as illustrated in FIGS. 1 and 2 (i.e., the first step being the combined right and left front side steps 34, 40, the second step being the combined right and left middle side steps 32, 38 and the third step being the combined right and left rear side steps 30, 36, which combined steps can be either continuous steps or adjacent right and left side steps), wave riding board 10 may include only one step, only two steps, or four or more steps. The steps may include one or more of a single continuous front step, a single continuous middle step, or a single continuous rear step rather than separate left and right side steps. The channel 27 may be located between, or extend through, any suitable number of steps rather than be located between, or extend through, all of the plurality of steps. In certain embodiments, channel 27 may not be present at all (e.g., when each step is continuous rather than separate right and left side steps). In alternative embodiments, the wave riding board may include three or more steps for each side step and include more than one channel. For example, the wave riding board may include a first front pair of steps and second front pair of steps, a first middle pair of steps and a second middle pair of steps and a first pair of rear steps and a second pair or rear steps. A channel may run through or be defined between one or more of each of the first pair of front, middle and rear steps, while a separate channel may run though or be defined between one or more of the second front, middle and rear pair of steps.

Referring more specifically to the plurality of steps 30-40 as illustrated in the embodiment of FIGS. 1 and 2, the right front side step 34 includes a front lateral wall 34*a* and a longitudinal wall 34*b*, the left front side step 40 includes a front lateral wall 40*a* and a longitudinal wall 40*b*, the right middle side step 32 includes a front lateral wall 32*a* and a longitudinal wall 32*b*, the left middle side step 38 includes a front lateral wall 38*a* and a longitudinal wall 38*b*, the right rear side step 30 includes a front lateral wall 30*a* and a longitudinal wall 30*b*, and the left rear side step 36 may include a front lateral wall 36*a* and a longitudinal wall 36*b*. The right rear side step 30 and left rear side step 36 may also include rear lateral walls 30*c* and 36*c*, respectively. In the illustrated embodiment, rear walls 30*c* and 36*c* define a rear edge or wall of the steps 30 and 36 respectively, and terminate in a rear portion of the board 10, which portion continues to extend further towards the rear 14 of the board 10. In alternative embodiments, the rear walls 30*c* and 36 may define the rear edge or rear wall of the board 10 itself.

Each of the front lateral walls 30*a*-40*a* extend in a generally caved shape or curved direction from the right edge 16 to the left edge 18 of the body 11, which can also be in a direction from the left edge 18 to the right edge 16. In certain embodiments, one or more of the front lateral walls 30*a*-40*a* may extend entirely across the body 11 from the right edge 16 to left edge 18 (which can also be a direction from the left edge 18 to the right edge 16) or may extend only partially to the edges 16 or 18 in a direction running from the right edge 16 to left edge 18 (which can also be a direction running from the left edge 18 to the right edge 16). While each of the illustrated front lateral walls 30*a*-40*a* extend in a generally curved shape or curved direction from the right edge 16 to the left edge 18 of the body 11 (which can also be a direction from the left edge 18 to the right edge 16), in certain other embodiments, the walls 30*a*-40*a* may extend in a generally straight shape or straight direction from the right edge 16 to the left edge 18 of the body 11 (which can also be in a direction from the left edge 18 to the right edge 16). In one example, when the lateral walls 30*a*-40*a* are curved, a center portion of each lateral wall 30*a*-40*a* is positioned further from the rear 14 of the body 11 than the portions that extend closer to the right or left edges 16, 18. Each lateral wall 30*a*-40*a* may slope generally upwardly towards the center channel 27 or a center portion of the body 11, or generally increase in height from a respective edge 16 or 18 of the body 11 (or near the edge 16 or 18) to the center channel 27 or to a center portion of the body 11.

Each longitudinal wall 30*b*-40*b* is located near a center portion of the body 11 and inwardly from the respective right or left edge 16, 18, and extends in a generally upwardly sloping straight or curved fashion from a front lateral wall of the respective side step to the front lateral wall of the next step located closer to the rear 14 of the body 11 (or in the case of the step that is positioned closest to the rear 14 of the body 11, to a rear lateral wall of that same step or the rear edge of the body 11, e.g., longitudinal walls 30*b* and 36*b* of steps 30 and 36 extend to rear lateral walls 30*c* or 36*c*, respectively or to a rear edge of the body 11). In other words, for each longitudinal wall 30*b*-40*b*, the height of that longitudinal wall increases from the front 12 to the rear 14 of the body 11. For example, FIG. 1 illustrates the height of longitudinal wall 40*b* f the left side step 40 increasing from a front height of 41*a* to a rear height 41*b*, the height of longitudinal wall 38*b* of the left side step 38 increasing from a front height of 39*a* to a rear height 39*b*, the height of longitudinal wall 36*b* of the left side step 36 increasing from a front height of 37*a* to a rear height 37*b*. The heights of the longitudinal walls of the adjacent right side steps 34, 32 and 30 likewise have heights that increase from the front 12 to the rear 14 of the body 11. The channel 27 runs through or is defined at least partially between the longitudinal walls of each of the steps, and may have a width 28 that increases from the front 12 to the rear 14 of the body 11, thereby forming a longitudinally a substantially triangular or triangular like shape. For example, the width 28 of channel 27 may gradually increase from width 28*a* at a front portion of the body 11, to a width 28*b* between longitudinal walls 40*a* and 34*a*, to a width 28*c* between longitudinal walls 38*a* and 32*a*, to a width 28*d* between longitudinal walls 36*b* and 30*b*. When the board 10 moves against the waves or current in the water, the lateral and longitudinal walls of each step 30-40 create individual voids or spaces under the steps 30-40 so that air (e.g., air 54 illustrated in FIG. 2) can flow under one or more of the steps 30-40 of the board 10 and create lift, while water can simultaneously flow smoothly through the center channel 27. When the board 10 moves with the waves or current in the water, the water (e.g., water 56 illustrated in FIG. 2) can collide with one or more of the lateral walls of the steps 30-40 to create additional thrust in the direction of the waves or current.

The front side steps, middle side steps and rear side steps (or single continuous steps) are spaced apart unevenly relative to each other in a longitudinal direction running from the front 12 to the rear 14 of the body 11 or the rear 14 to the front 12 of the body 11. That is, the amount of space created by respective walls (and defining surfaces created by the walls) for each step is different from each of the other steps. In the illustrated embodiment, the amount of space under the front step (which can be a single continuous step or one or more separate side steps like the right and left side steps), is greater than the amount of space under the middle step (which can also be a single continuous step or one or more separate side steps like the right and left side steps), and the amount of space under the middle step is greater than the amount of space under the rear step (which can also be a single continuous step or one or more separate side steps like right and left side steps).

In particular and referring to the embodiment illustrated in FIG. 2, the first step (e.g., left side step 40) includes a longitudinal distance 44 defined from the front lateral wall 40*a* of the left front side step 40 to the front lateral wall 38*a* of the left middle side step 38. The second step (e.g., left side step 38) includes a longitudinal distance 46 defined from the front lateral wall 38*a* of the left side step 38 to the front lateral wall 36*a* of the rear side step 36. The longitudinal distance 44 is greater than the longitudinal distance 46. Similarly, the third step (e.g., left side step 36) includes a longitudinal distance 48 defined from the front lateral wall 36*a* of the left side step 36 and a rear lateral wall 36*c* of the rear left side step 36 (or the edge of the board 10 in an alternative embodiment where the step(s) 36 are the rear edge of the board 10). The longitudinal distance 46 is greater than the longitudinal distance 48. Likewise, the right front side step 34, right middle side step 32 and right rear side step 30 each have the same or substantially the same longitudinal distances as illustrated in FIG. 2 for the respective left side steps 40, 38 and 36. The greater volume or space under the front step(s) relative to the middle or second step(s), and the greater volume or space under the second or middle step(s) relative to the third or rear step(s), helps to eliminate hydrodynamic drag on the board 10 due to the volume of water under the board 10 from the first step(s) to the second step(s) (going from front to rear) being greater than the volume of water under the board 10 from the second step(s) to the third step(s) or a rear wall of the second step (going from front to rear). The greater water volume under the front or first step or steps create greater water pressure under the front step or steps, which pushes clear the smaller and lighter volume of water under the second or middle steps, and the greater volume under the second, middle step relative to the third or rear step creates greater water pressure under the second or middle step, which pushes clear the smaller and lighter volume of water under the third step. This advantageous hydrodynamic result occurs with any number of unevenly spaced apart steps according to the present disclosure. Likewise, it should be appreciated that the wall dimensions and/or longitudinal lengths for the steps of the present disclosure may be any suitable lengths or dimensions that provide the hydrodynamic advantages described herein.

It should further be appreciated that the wave riding boards of the present disclosure may comprise any material suitable for wave riding. In one example, the boards may include one or more of mushroom, fungus, wood, balsa wood, fiberglass, carbon fiber, EPS (expanded polystyrene), any resin, any polymer, any plastic, any bio-resin, any bio-polymer, any epoxy, and polyurethane, along with other material(s).

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A wave riding board comprising:

a body including a top, a bottom, a right edge, a left edge, a front, a rear and a length defined from the front to the rear, the bottom of the body including a plurality of steps that each increase in height as measured from the top of the body from a position near an edge of the body to a channel defined at least partially between the plurality of steps, the channel extending along at least a portion of the length of the body and defining a substantially triangular shape, wherein a forward portion of the channel extends forwardly of a forwardmost front lateral wall.

2. The wave riding board of claim 1, wherein the channel is located at a center portion of the bottom of the body and terminates forwardly of the rear of the body.

3. The wave riding board of claim 1, wherein (i) the plurality of steps include a first right side step, a first left side step, a second right side step and a second left side step, the second right side step and a second left side step each positioned closer to the rear of the body than the first right side step and the left side step respectively, (ii) the channel includes a width defined between (a) the first right side step and the first left front side step and (b) the second right side step and the second left side step, and (iii) the width of the channel increases from the front of the body to the rear of the body.

4. The wave riding board of claim 1, wherein (i) each of the plurality of steps includes a front lateral wall, and (ii) each front lateral wall of the plurality of steps extends in a direction from the right edge of the body to the left edge of the body or in a direction from the left edge of the body to the right edge of the body.

5. The wave riding board of claim 1, wherein each of the plurality of steps includes a front lateral front wall that curves in a direction from the right edge of the body to the left edge of the body or in a direction from a left edge of the body to the right edge of the body.

6. The wave riding board of claim 1, wherein (i) the plurality of steps include a first step including a front lateral wall, (ii) a second step positioned closer to the rear of the body than the first step and including a front lateral wall, (iii) the first step includes a longitudinal distance defined from the front lateral wall of the first step to the front lateral wall of the second step, (iv) the second step includes a longitudinal distance defined from the front lateral wall of the second step to (a) the front lateral wall of a third step positioned closer to the rear of the body than the second step or (b) a rear lateral wall of the second step, and (v) the longitudinal distance of the first step is different from the longitudinal distance of the second step.

7. The wave riding board of claim 1, wherein (i) the plurality of steps include a first step including a front lateral wall, (ii) a second step positioned closer to the rear of the body than the first step and including a front lateral wall, (iii) the first step includes a longitudinal distance defined from the front lateral wall of the first step to the front lateral wall of the second step, (iv) the second step includes a longitudinal distance defined from the front lateral wall of the second step to (a) the front lateral wall of a third step positioned closer to the rear of the body than the second step or (b) a rear lateral wall of the second step, and (v) the longitudinal distance of the first step is greater than the longitudinal distance of the second step.

8. The wave riding board of claim 1, wherein the body defines a center longitudinal axis and the plurality of steps include (i) a first right side step including a front lateral wall and a longitudinal wall, (ii) a first left side step including a front lateral wall and a longitudinal wall, (iii) a second right side step including a front lateral wall and a longitudinal wall, (iv) a second left side step including a front lateral wall and a longitudinal wall, (v) the first right side step and the first left side step are substantially symmetrical about the center longitudinal axis, and (vi) the second right side step and the second left side step are substantially symmetrical about the center longitudinal axis.

9. The wave riding board of claim 1, wherein the body defines a center longitudinal axis and the plurality of steps include (i) a first right side step including a front lateral wall and a longitudinal wall, (ii) a first left side step including a front lateral wall and a longitudinal wall, (iii) a second right side step including a front lateral wall and a longitudinal wall, (iv) a second left side step including a front lateral wall and a longitudinal wall, (v) the first right side step and the first left side step are substantially symmetrical about the center longitudinal axis, (vi) the second right side step and the second left side step are substantially symmetrical about the center longitudinal axis, and (vii) the channel is defined at least in between the longitudinal wall of the first right side step, the longitudinal wall of the first left side step, the longitudinal wall of the second right side step, and the longitudinal wall of the second left side step.

10. The wave riding board of claim 1, wherein (i) the plurality of steps include a front step having a front lateral wall, and (ii) the channel extends longitudinally beyond the front lateral wall of the front step towards the front of the body.

11. A wave riding board comprising:

a body including a top, a bottom, a right edge, a left edge, a front, a rear, and a length defined from the front to the rear, the bottom of the body including a plurality of steps including a first step having a first front lateral wall, a second step positioned closer to the rear of the body than the first step and having a second front lateral wall, and a third step positioned closer to the rear of the body than the second step and having a third front lateral wall, wherein (i) the first step includes a right side step having a longitudinal wall and a left side step having a longitudinal wall, the longitudinal walls of each of the right and left side steps of the first step each including a height that increases from the front of the body to the rear of the body, the first step further defines a first longitudinal distance from the first front lateral wall to the second front lateral wall, (ii) the second step includes a right side step having a longitudinal wall and a left side step having a longitudinal wall, each of the longitudinal walls of the right and left side steps of the second step including a height that increases from the front of the body to the rear of the body, the second step further defines a second longitudinal distance from the second front lateral wall to the third front lateral wall positioned closer to the rear of the body than the second front lateral wall, (iii) the third step defines a third longitudinal distance from the third front lateral wall to a rear lateral wall of the third step, and (iv) the first, second, and third longitudinal distances are different from each other.

12. The wave riding board of claim 11, wherein the first longitudinal distance is greater than the second longitudinal distance.

13. The wave riding board of claim 11, wherein the first front lateral wall and the second front lateral wall each extend in a direction from the right edge of the body to the left edge of the body or in a direction from the left edge of the body to the right edge of the body.

14. The wave riding board of claim 11, which includes a channel extending along at least a portion of the length of the body and located at a center portion of the body, the channel defined between longitudinal walls of the first and second steps.

15. The wave riding board of claim 11, wherein (i) the first step includes a right side step and a left side step and (ii) the second step includes a right side step and a left side step, (iii) the bottom includes a channel defined between the right and left side steps of the first and second steps, and (iv) the channel including a width that increases from the front of the body to the rear of the body.

16. The wave riding board of claim 11, wherein (i) the body defines a longitudinal axis (ii) the first step includes a first right side step, a first left side step, (iii) the second step includes a right side step and a left side step, (iv) the first front lateral wall includes a front lateral wall for the right and left side steps of the first step, (v) the second front lateral wall includes a front lateral wall for the right and left side steps of the second step, (vi) each of the right and left side steps of the first step include a longitudinal wall, (vii) each of the right and left side steps of the second step include a longitudinal wall, (viii) the first step includes a longitudinal distance defined from the front lateral walls of the right side step and the left side step to the front lateral walls of the second right side step and the second left side step, respectively, (ix) the second step includes a longitudinal distance defined from the front lateral walls of the second right side step and the second left side step to (a) the front lateral walls of a third right side step and a third left side step each positioned closer to the rear of the body than the second step or (b) rear lateral walls of the second right side step and the second left side step, and (x) the longitudinal distance of the first step is greater than the longitudinal distance of the second step.

17. The wave riding board of claim 11, wherein each of the first front lateral wall and the second front lateral wall curves in a direction from the right edge of the body to the left edge of the body or in a direction from the left edge of the body to the right edge of the body.

18. A wave riding board comprising:

a body defining a top, a bottom, a right edge, a left edge, a front, a rear and a length defined from the front to the rear, the bottom of the body defining a first step and a second step, the first step including a front lateral wall and extending a first longitudinal distance defined from the front lateral wall of the first step to a front lateral wall of the second step, the second step including a longitudinal distance defined from the front lateral wall of the second step to a front lateral wall of a third step, wherein a rear lateral wall extends closer to the top of the body than the front lateral wall of the first step or the front lateral wall of the second step, and a center channel defined at least partially between each of the first and second steps, the center channel extending along at least a portion of the length of the body.

* * * * *